United States Patent [19]

Wise

[11] 4,019,636

[45] Apr. 26, 1977

[54] STRAND PACKAGE AND CARTON THEREFOR

[75] Inventor: Thomas Q. Wise, Glen Ellyn, Ill.

[73] Assignee: Belden Corporation, Geneva, Ill.

[22] Filed: Nov. 3, 1975

[21] Appl. No.: 628,528

[52] U.S. Cl. ..... 206/396; 206/409; 229/7 R

[51] Int. Cl.[2] ..... B65D 85/67

[58] Field of Search ..... 229/17 R, 17 S, 7 R; 206/392, 395–397, 408, 409

[56] References Cited

UNITED STATES PATENTS

| | | | |
|---|---|---|---|
| 1,889,933 | 12/1932 | Pratt | 206/396 |
| 2,706,592 | 4/1955 | Schaller | 206/395 |
| 2,743,009 | 4/1956 | Williamson et al. | 206/396 |
| 3,229,812 | 1/1966 | Metzer | 206/396 |
| 3,823,894 | 7/1974 | Frederick et al. | 206/409 |

FOREIGN PATENTS OR APPLICATIONS

| | | | |
|---|---|---|---|
| 993,282 | 10/1951 | France | 206/395 |

*Primary Examiner*—William Price
*Assistant Examiner*—Douglas B. Farrow
*Attorney, Agent, or Firm*—Fitch, Even, Tabin & Luedeka

[57] ABSTRACT

A dispensing package of coiled strand material has an open-center coil of the material capable of being payed out from the coil's interior. A series of connected walls form a perimeter around the coil, and each of the walls has opposed hinged flaps. A tab is located on the edge of each flap opposite the hinged connection, and the tabs on each side of the coil interlock to form a tapered boss extending into the open center of the coil spaced from but facing the like opposing boss.

6 Claims, 8 Drawing Figures

STRAND PACKAGE AND CARTON THEREFOR

This invention relates to dispensing type packages and, more particularly, to a carton containing a wound coil of strand material and the dispensing of the strand material.

The invention is applicable to packages of strand material coiled with an open center or "air core" to permit the free inner end of the strand material to be withdrawn from the interior of the coil in the payout of the material. Such non-reel packages serve as means for both shipping and dispensing strand material and are suitable for strands of various types.

Heretofore, packages of the non-reel type have utilized a conventional cardboard carton with separate cones inserted into the open center of the coil to facilitate the unreeling of the strand material from the interior of the coil. These separate inserts complicate the packaging operation and increase the cost of the package.

Accordingly, it is a primary object of this invention to simplify shipping and dispensing packages of coiled strand material by providing dispensing guides which are an integral part of the packing carton, being formed in the process of setting up the carton to receive and to enclose the coil.

The accomplishment of this and other objects of the invention will become apparent from the following description and its accompanying drawings of which:

Briefly, the invention is a package comprising a carton holding a coil of strand material. The carton is formed with a perimeter of four walls end to end around the coil, and each wall has a flap connected to both its opposing side edges. The flaps each have a tab thereon. The tabs interlock on each side of the coil to form a tapered boss that extends into the open center of the coil. The bosses face one another, but are spaced apart. As the strand material is withdrawn from the interior of the coil, the tapered bosses guide the strand into the gap between them for withdrawal from the package through a removable feed tube formed of two telescoped and interlocked tubes abutting opposite sides of one wall of the carton.

Figures 1, 2, 3, 4, 5, 6, 7:
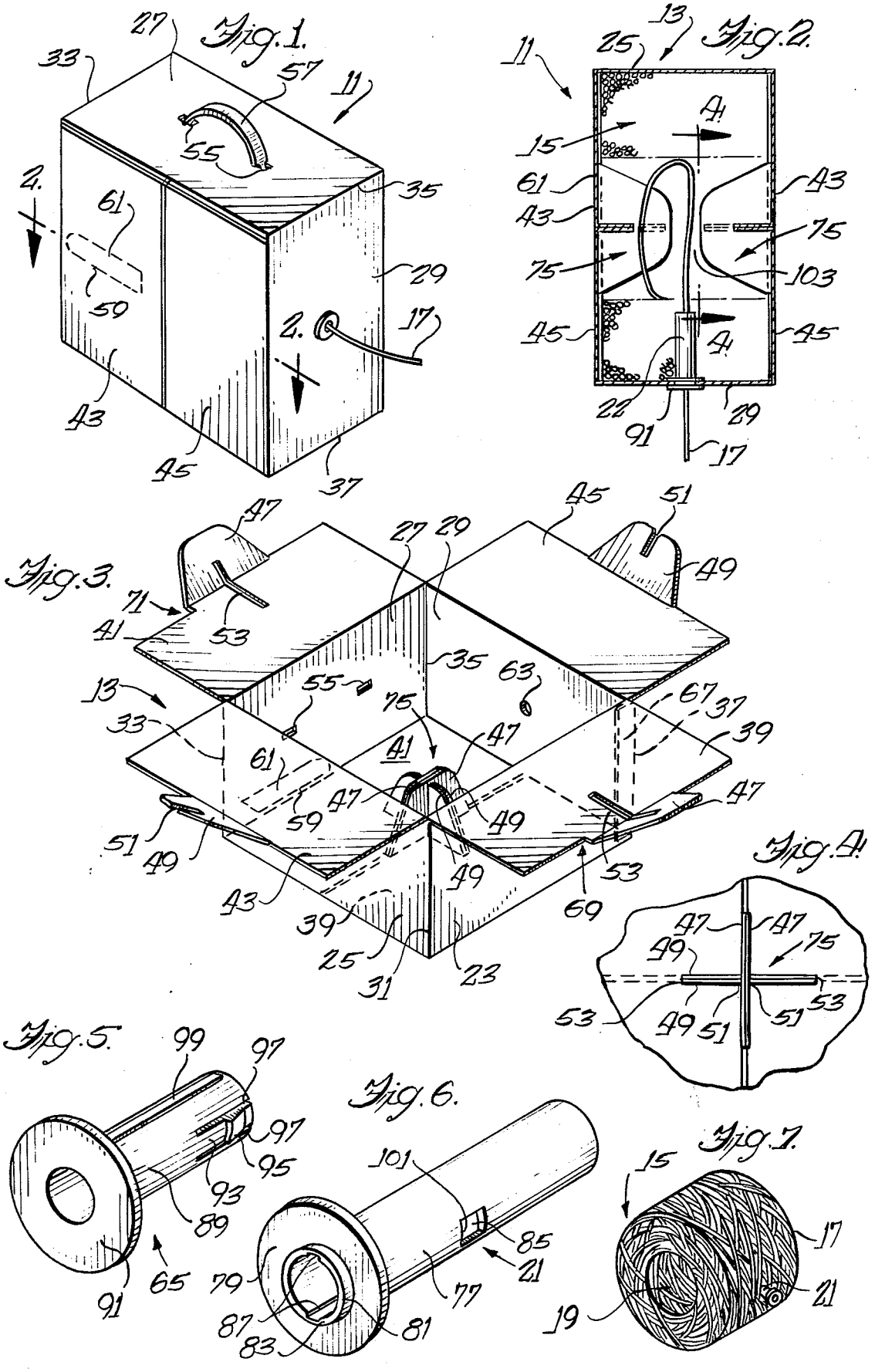
FIG. 1 is a perspective view of a package in accordance with the invention.
FIG. 2 is a sectional view taken along the line 2-2 of the package of FIG. 1 and illustrating the relation internally of the package structure and contents.
FIG. 3 is a perspective view of an assembled carton used in the package of FIG. 1, the carton shown with a set of flaps open to better illustrate its construction.
FIG. 4 is a fragmentary internal view of a portion of the package taken along the line 4—4 of FIG. 2.
FIG. 5 is a perspective view of an inner part of a feed tube used in the package of FIG. 1.
FIG. 6 is a perspective view of an outer part of the feed tube.
FIG. 7 is a perspective view depicting an association of a coil of strand material and the outer part of the feed tube used in the package of FIG. 1.

Referring first to FIGS. 1, 3 and 7, there is shown a package 11 comprising a carton 13 and a coil 15 of strand material, such as a cable or wire 17. To simplify the description, the strand material will be referred to hereinafter as the wire 17, but it should be understood that this invention is not limited to wire or cable and can include various other forms of strand material.

The coil 15 may be wound in any suitable manner that will result in a coil that has an open center 19 and that is capable of having the wire 17 payed out from the interior of the coil. An outer tube 21 of a feed tube 22 (FIG. 2) is inserted radially of the coil 15 to provide a channel radially through the body of the coil to the open center 19 through which the free inner end of the wire 17 is fed for the withdrawing of the wire from the package 11, as described in detail hereinafter.

The carton 13 comprises four wall panels 23, 25, 27, and 29. These panels are joined in end-to-end relation by hinge connections 31, 33, 35 and 37 respectively to form the perimeter of the assembled carton 13. Inner closure flaps 39 are hingedly connected to each of the opposed side edges of the wall panel 23. Inner closure flaps 41 are hingedly connected to each of the opposed side edges of the wall panel 27. Outer closure flaps 43 are hingedly connected to each of the opposed side edges of wall panel 25, and outer closure flaps 45 are hingedly connected to each of the opposed side edges of the wall panel 29.

Tabs 47 are hinged to the center of the free side edge of each of the inner closure flaps 39 and 41. Tabs 49 are hinged to the center of the free side edge of each of the outer closure flaps 43 and 45. All of the tabs 47 and 49 are generally tapered, although their free tip ends may be generally rounded as indicated, providing a truncated form.

Open-ended slots 51 are provided in the free end of the tabs 49. These slots extend longitudinally of the tabs from the tabs' free edges to a point short of the line of connection of the tabs to their adjacent outer flaps.

Internal slots 53 are provided in the tabs 47. These slots also extend longitudinally of the tabs but begin inwardly of the tabs' free ends and extend across the connections of the tabs to their adjacent inner flaps and into these adjacent flaps. Thus, when the tabs 47 are folded along their connection lines, a portion of the slots 53 are located in the tabs 47 and a portion in their adjacent inner flaps 39 and 41. In the illustrated embodiment, the portion of each slot 53 in the flaps 39 and 41 is longer to accommodate the base of the tabs 49, as will be seen hereinafter.

A pair of slots 55 are provided in the wall panel 27 to accommodate an interlocking of a carrying handle 57 with the wall panel 27. As an alternative to this handle and slot combination, a hand-hold (not shown) in the form of a partially cut-out oval section that is foldable inwardly to provide a carrying slot could be provided in the wall panel 25 near the edge connecting with the wall panel 27. Only one such slot would be required for the package.

A perforated tear line 59 in one of the outer flaps 43 defines an elongated removable panel section 61 which when removed provides the package 11 with a vision slot. This perforated tear line 59 is radially located with reference to the axis of coil 15 when the coil is in the package 11, and the ultimate vision slot extends from the edge of the wall panel 25 to a point short of the center of the package so that the coil of material in the package may be exposed and the amount of material remaining in the coil may be seen. If desired, graduation marks or other suitable indicia could be marked along the sides of the removable section 61 to facilitate the determination of the amount of material remaining in the coil.

A further opening 63 is provided in the center of the wall panel 29 for receiving a portion of the outer tube 21 of the feed tube 22 assembly which will be seen hereinafter.

A joint flap 67 is hinged at 37 to the wall panel 29 and is bonded in a suitable manner to the inside surface of the wall panel 23 near the free end of this panel in forming the assembled carton 13. Other suitable joining means could be utilized for this purpose.

A notch 69 is made in the free edge of the inner flap 39 that is on the same side of the carton as the outer flap 43 that has the removable section 61. The notch extends along this free edge from the end of the flap adjacent the wall panel 25 to a point near the associated tab 47. A notch 71 is made in mirror image fashion to the notch 69 in the free edge of the inner flap 41 that is also on this side of the carton. When these flaps 39 and 41 are folded inwardly, the two notches oppose one another to form a rectangular opening beneath the removable section 61 so that when the section 61 is removed, the interior of the carton may be seen through the vision slot.

Figure 8:
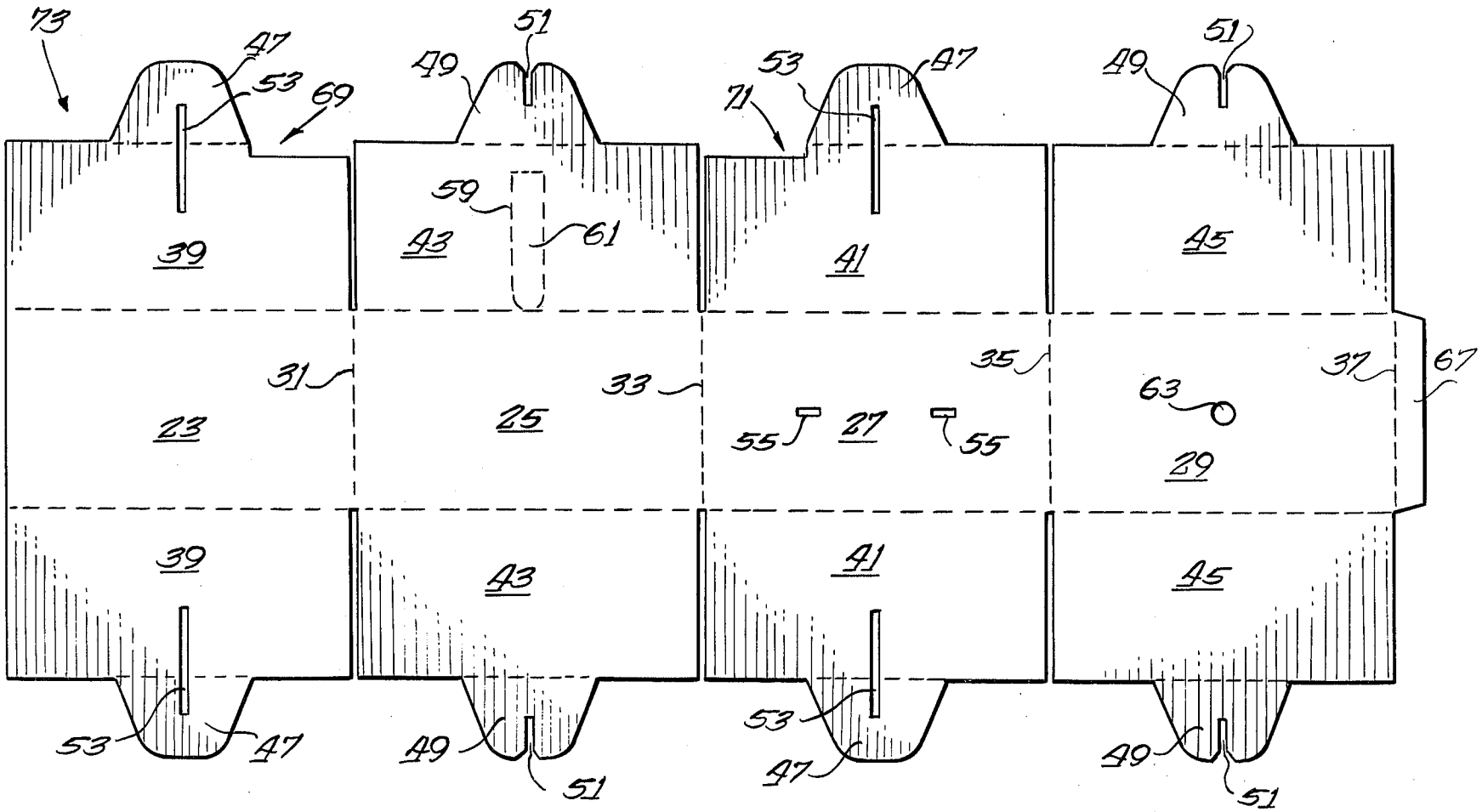
FIG. 8 is a plan view of a carton blank used in forming the carton of FIG. 3.

FIG. 8 shows the blank 73 used to form the carton 13 (FIG. 3), its four wall panels 23, 25, 27, and 29 being hinged in end-to-end relation at 31, 33, and 35. A joint flap 67 is hinged at 37 to the free end of the wall panel 29. Inner flaps 39 and 41 are hinged to each of the opposed side edges of the first and third wall panels from the left as viewed in FIG. 8, i.e., wall panels 23 and 27, their associated tabs 47 having the internal slots 53.

Outer closure flaps 43 and 45 are hinged to each of the opposed side edges of the second and fourth wall panels, i.e., wall panels 25 and 29, their associated tabs 49 having the open-ended slots 51. It will be noted that the internal slots 53, as mentioned previously, extend from the tabs 47 into the adjacent flaps, whereas the open-ended slots 51 in the tabs 49 extend inwardly from the free end of the tabs, but not to the point of connection of the tabs to their adjacent flaps.

The carton 13 is assembled by folding the blank 73 into the form depicted in FIG. 3. Thus, the wall panels 23, 25, 27, and 29 are folded along their hinged end connections to form the perimeter of the basic enclosure utilizing the joint flap 67 to secure the structure. Next, the inner closure flaps 39 and 41 are folded inwardly on each side of the wall panels 23 and 27. The tabs 47 are also folded inwardly, and when the flaps are thus folded, a pair of tabs 47 abut one another and extend into the interior of the carton upon closing the flaps.

The outer closure flaps 43 and 45 and the associated tabs 49 are then all folded inwardly. When a pair of the folded tabs abut one another on each side of the wall panels 25 and 29, they are inserted through the slots 53 of the previously closed inner panels. As the slots 53 receive the tabs 49, the slots 51 thereof engage the outer walls of the abutting tabs 47. The tabs are thus interlocked in a perpendicular relation as shown in FIGS. 3 and 4 to form a boss 75 extending inwardly of the carton on each side of the wall panels 25 and 29 are shown in FIG. 2. These bosses 75 extend into the open center 19 of the coil 15 as discussed hereinafter.

The package 11 is formed by placing a coil 15 into a carton 13 that is in the formed condition shown in FIG. 3 so that the open center 19 is over the boss 75. The coil is rotated in this position until the outer tube 21, which was inserted through the body of the coil either at the time of winding or subsequent thereto, to adjacent the opening 63 in the wall panel 29.

As best seen in FIG. 6, this outer tube 21 comprises a tube body 77 and a flange 79. The flange 79 is located near one end of the tube body 77, but it is not flush with that end. A short portion 81 of the tube body 77 extends in front of the flange 79. The length of this short portion 81 is substantially the same as the thickness of the wall panel 29 of the carton. Thus, as the coil 15 is placed in the carton the short portion 81 is located in inserted relation with the opening 63, and the flange 79 abuts the inside surface of the wall panel 29 adjacent the opening 63. An end edge 83 of the short portion 81 is thereby substantially flush with the outer surface of the wall panel 29.

The tube body 77 has at least one latch aperture 85 through its wall in spaced relation to the rear surface of the flange 79. A keyway 87 is located in the interior wall of the tube body 77 in a circumferential location that does not coincide with the latch aperture 85. To complete the feed tube 22 assembly, the inner tube 65 is inserted in telescoped relation into the outer tube 21 from the outside of the carton.

As shown in FIG. 5, the inner tube 65 comprises a tube body 89 and a flange 91. The flange 91 is located at one end of the tube body 89 and, in this instance, is flush therewith. At the other end of the tube body 89 is at least one spring latch 93. Near the end of the spring latch 93 is a built-up portion providing a shoulder 95. This spring latch 93 is formed by making a pair of spaced apart, open-ended slits 97 that extend inwardly from the free end of the tube body 89. In the illustrated embodiment, these slits 97 are parallel and extend inwardly a distance equal to approximately one-third the length of the tube body 89. A longitudinally extending key 99 is provided on the outer surface of the tube body 89 and is adapted to complement the keyway 87 of the outer tube 21 and slide therein when the tubes are telescoped to form the assembled feed tube 22. The distance of the shoulder 95 from the flange 91 is substantially equal to the distance from the end edge 83 of the outer tube 21 to a front edge 101 of the latch aperture 85 of the outer tube 21. The circumferential distance and direction from the key 99 to the spring latch 93 is substantially equal to the corresponding distance and direction from the keyway 87 to the latch aperture 85.

Accordingly, when the inner tube 65 is inserted in telescopic relation in the outer tube 21, the spring latch 93 and the latch aperture 85 are aligned and the shoulder 95 engages the front edge 101 of the aperture. The spring nature of the latch 93 urges the continued engagement of the shoulder 95 and the front edge 101 to maintain the interlocked condition of the tubes. Thus locked, the feed tube 22 is secured in the carton because the flanges 91 and 79 abut opposite sides of the carton wall 29 surrounding the opening 63. In this illustrated embodiment, these tubes 21 and 65 are made of plastic.

The inner end of the wire 17 is then fed into the feed tube 22 and secured in a suitable manner, such as by a plug (not shown), to the outer flange 91.

The carton 13 is then closed to complete the package by folding the inner closure flaps 39 and 41 inwardly and then folding the outer closure flaps 43 and 45 thereover, the tabs 49 being inserted in the slots 53 in interlocking relation to form the tapered boss 75 as described previously. The interlocking tabs also serve to hold the carton closed. The carton further may be sealed for shipment.

In the preferred embodiment, the four wall panels 23, 25, 27, and 29 are of equal length and form a square around the coil 15. Thus, the coil is held in position by its tangential contact with the four walls. The coil 15 is, of course, wound so that its outer diameter and its length is substantially equal to the corresponding inner dimensions of the carton 13. This forms a compact, stabilized package for shipping purposes. No hubs or other supporting means are required on the interior of the coil, and even during dispensing, the stability of the package is maintained because the wire 17 is payed out from the interior of the coil, leaving the external dimensions substantially constant until the coil is depleted.

At the receiving end, the package 11 is placed in the upright position shown in FIG. 1, the vision slot is formed by removing the flap section 61 along the perforated tear line 59 and the securing means of the free end of the wire 17 is removed to allow the dispensing of the wire.

Referring now to FIG. 2, there is shown a sectional view of the interior of the package as viewed from the top. The inwardly projecting bosses 75 each made of the tapered tabs appear as truncated conical sections opposing but separated from one another at their facing truncated ends by a gap 103. The wire 17 is withdrawn through the feed tube 22, always working from the inner layer of the coil 15. The tapered sides of the bosses 75 facilitate the withdrawing of the wire 17 as a loop of the wire is guided thereby into the gap 103 in an orderly manner. Such an arrangement keeps the loops from snarling or kinking. The rate of withdrawal can be speeded up, slowed down, or stopped without ill effects, and there is no need for separate apparatus controlling the dispensing of the wire.

One example of a specific construction is a blank 73 having a stock thickness of approximately one-eighth of an inch. The wall panels 23, 25, 27 and 29 are nine and one-quarter inches wide and 16 inches long. The flaps 39, 41, 43 and 45 are eight inches wide and substantially equal in length to their adjacent wall panels. The tabs 47 and 49 are approximately six and onehalf inches wide at their base and approximately four inches long. The flap section 61 is approximately one and one-half inches wide and six and one-half inches long. When folded, this blank makes a carton 13 having approximate outside dimensions of 16-¼ inches × 16-¼ inches × 9-½ inches. The resulting bosses 75 extend approximately 4 inches inwardly toward each other leaving a gap 103 approximately one and one-quarter inches. The assembled feed tube 22 has an overall length of approximately four inches and an I.D. of approximately three-quarters of an inch.

Thus, the illustrated package 11 is a simplified shipping and dispensing package that has dispensing guides as an integral part of the packing carton. The wire may be dispensed right from the package and fed directly into conduit for easy tangle-free installation or into winding equipment with no snarls or backlash. The wire will flow freely and stop instantly when pulling stops. There is no reel inertia to overcome on stop and start, and there is no need for tensioning devices. The package is compact and saves space in transportation and at the job site. When the package is empty, the remaining carton is easily disposed of, and there are no reels or spools to be returned or otherwise handled. The wire 17 can be withdrawn from the package 11 at most any angle. Withdrawing of the wire can be interrupted at any time and the package easily carried to a different site.

Although the invention has been described in connection with a preferred embodiment, alternatives, modifications, and variations will be apparent to those skilled in the art in view of the foregoing description. Accordingly, it is intended to embrace all such alternatives, modifications, and variations as fall within the spirit and scope of the appended claims.

What is claimed is:

1. A non-reel dispensing package of coiled strand material comprising an open-center coil of the material capable of being payed out from the interior thereof without rotation of the coil; a perimeter of connected walls surrounding said coil, each said wall having opposed hinged flaps; and a tapered tab located at the center of the edge of each of said flaps opposite the hinged connection thereof to its associated wall, the tabs of the flaps on each of the two opposing sides of said coil interlocking to form a tapered boss to facilitate payout of the strand material, the two bosses extending into the open center of the coil in spaced facing relation, their facing ends being separated by a gap.

2. A dispensing package in accordance with claim 1 wherein said perimeter comprises four connected walls of equal length forming substantially a square around said coil and each said tapered boss comprises two pairs of opposing tabs, the pairs being perpendicular to each other, the tabs of one such pair having open-ended slots therein, the tabs of the other pair having internal slots therein, and the tabs having the internal slots receiving the tabs having the open-ended slots in interlocking relation.

3. A dispensing package in accordance with claim 1 further comprising a feed tube extending through one of said walls and radially through said coil through which the strand material is payed out of the package from the interior of said coil.

4. A carton blank for a dispensing package of coiled strand material comprising four wall panels hinged in end-to-end relation, a flap hinged to each of the opposed side edges of each said panel, and a tapered tab hinged to the center of the free side edge of each said flap, the tabs associated with a first and third wall panel each having an open-ended slot extending longitudinally of the tab from its free end and the tabs associated with the alternate second and fourth wall panels each having an internal slot extending longitudinally of the tab and into its adjacent flap.

5. A blank in accordance with claim 4 further comprising a joint flap hinged to the free end edge of one of the outside wall panels.

6. A blank in accordance with claim 4 wherein said four wall panels are of equal length.

* * * * *